United States Patent [19]

Burgess

[11] 4,065,863

[45] Jan. 3, 1978

[54] MENU PLANNER

[76] Inventor: Roy Burgess, 25 Grey Oaks Road, Carmel, N.Y. 10512

[21] Appl. No.: 731,548

[22] Filed: Oct. 13, 1976

[51] Int. Cl.[2] ..... G09F 11/00

[52] U.S. Cl. ..... 40/490; 116/135; 235/89 R

[58] Field of Search ..... 40/65, 64 R; 116/135; 235/89 R, 70 A; 35/75, 31 E

[56] References Cited

U.S. PATENT DOCUMENTS

| | | | |
|---|---|---|---|
| 2,171,873 | 9/1939 | Gould | 40/65 X |
| 2,805,501 | 9/1957 | Miller | 40/65 X |
| 2,956,358 | 10/1960 | Pennington | 40/70 R |
| 3,491,715 | 1/1970 | Longarini | 40/64 R X |
| 3,536,897 | 10/1970 | Hubbard et al. | 116/135 X |
| 3,747,847 | 7/1973 | Cohen | 235/89 R |

*Primary Examiner*—John F. Pitrelli
*Attorney, Agent, or Firm*—Karl H. Gross

[57] ABSTRACT

A menu-planner, comprising a jacket element bounding an interior space and having an exposed outer surface provided with a first window and with two elongated substantially parallel second windows.

First indicia are provided on the surfaces, including a list of consecutively numbered recipes and two pair of ingredient lists, the lists of each of the pairs flanking a respective one of the second windows along opposite lateral sides thereof with the ingredients of each list being arranged seriatim along the length of the respective window.

Movable members move in the space relative to the windows to a plurality of positions in each of which a portion of the movable members is exposed outside the space.

Second indicia are provided on the movable members and indicative of recipe numbers, proportions of the ingredients and instructions for preparation of the respective recipe so that, upon movement of the movable members to a position in which a selected recipe number appears in the first window, indicia indicative of the proportions in which respective ones of the ingredients are required for the selected recipe will appear in the second windows opposite the required ingredients and preparation instructions will become exposed on the portion of the movable members outside the space and adjacent the surface.

11 Claims, 3 Drawing Figures

MENU PLANNER

BACKGROUND OF THE INVENTION

This invention relates to a novel menu planner.

In particular, the invention relates to a menu guide which offers the user, particularly the hostess for such fuctions as teas, cocktail hours, parties and the like, a quick way of selecting a recipe, determining the ingredients needed and their proportions, and obtaining concise preparation instructions.

It is evidently possible to obtain recipes of the greatest variety by turning to various kinds of cook books. However, there are situations — such as last-minute luncheons or the like — in which this is not practicable; then again, particularly the young hostess may not wish — or may not have the time — to search through various cook books until she finds e.g. a recipe for a spread which appeals to her. To date, there has been no aid to which one could turn under such circumstances.

SUMMARY OF THE INVENTION

It is the general object of the invention to provide a novel, efficient and simple-to-use- menu planner.

A more particular object of the invention is to provide such a menu planner which offers a rather large selection of recipes of a kind in a small space.

A further object is to provide a menu planner of the type in question wherein the ingredients needed for a particular recipe, their proportions and the manner of preparing the recipe from these ingredients, are all determinable with great simplicity and the utmost rapidity.

Another object is to provide such a menu planner which operates in the manner of a slide rule, i.e. the linear or the circular variety.

A concomitant object is to provide a menu planner of this type which provides instant read-out of the required information with the least amount of effort on the part of the user, and also in the smallest possible space.

In keeping with the above objects, and with still others which will become apparent hereafter, one feature of the invention resides in a menu-planner which, briefly stated, comprises a jacket element bounding an interior space and having an exposed outer surface provided with a first window and with two elongated substantially parallel second windows.

First indicia means are provided on the surface, including a list of consecutively numbered recipes and two pair of ingredient lists, the lists of each of the pairs flanking a respective one of the second windows along opposite lateral sides thereof with the ingredients of each list being arranged along the length of the respective window.

Movable members move in the space relative to the windows to a plurality of positions in each of which a portion of the movable means is exposed outside the space; and second indicia means are provided on the movable means and indicative of recipe numbers, proportions of said ingredients and instructions for preparation of the respective recipe so that, upon movement of the movable means to a position in which a selected recipe number appears in the first window, indicia indicative of the portions in which respective ones of the ingredients are required for the selected recipe will appear in the second windows opposite the required ingredients and preparation instructions will become exposed on the portion of the movable means outside the space and adjacent the surface.

The invention will hereafter be described with reference to currently preferred specific embodiments. The novel aspects of the invention, however, are not limited to the embodiments shown, but instead are defined exclusively in the claims.

DESCRIPTION OF PREFERRED EMBODIMENTS

Figure 1:
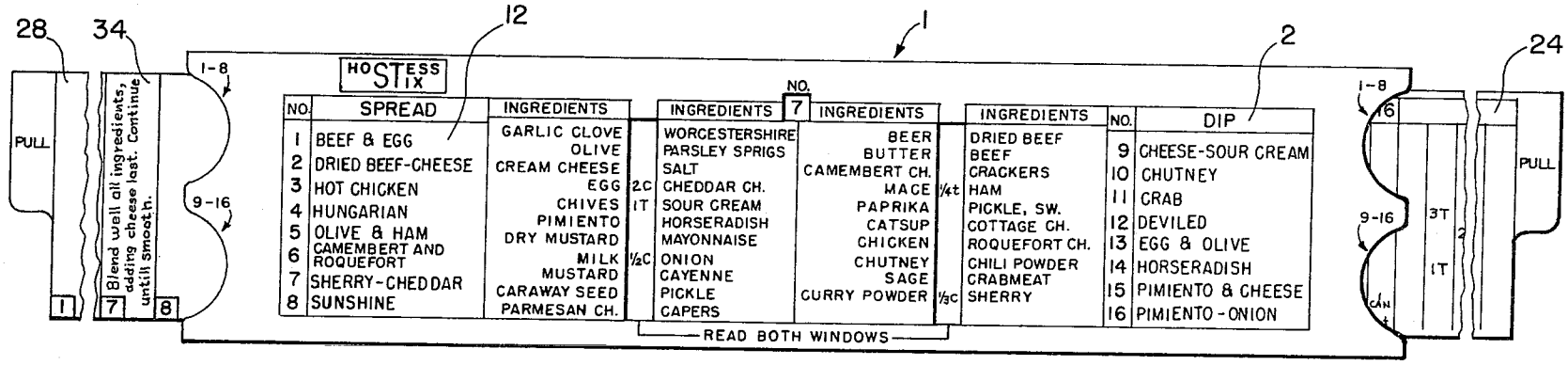
FIG. 1 is a plan view, illustrating one embodiment of the invention in a position in which the information pertaining to one of the recipes is set for readout.
Figure 2:
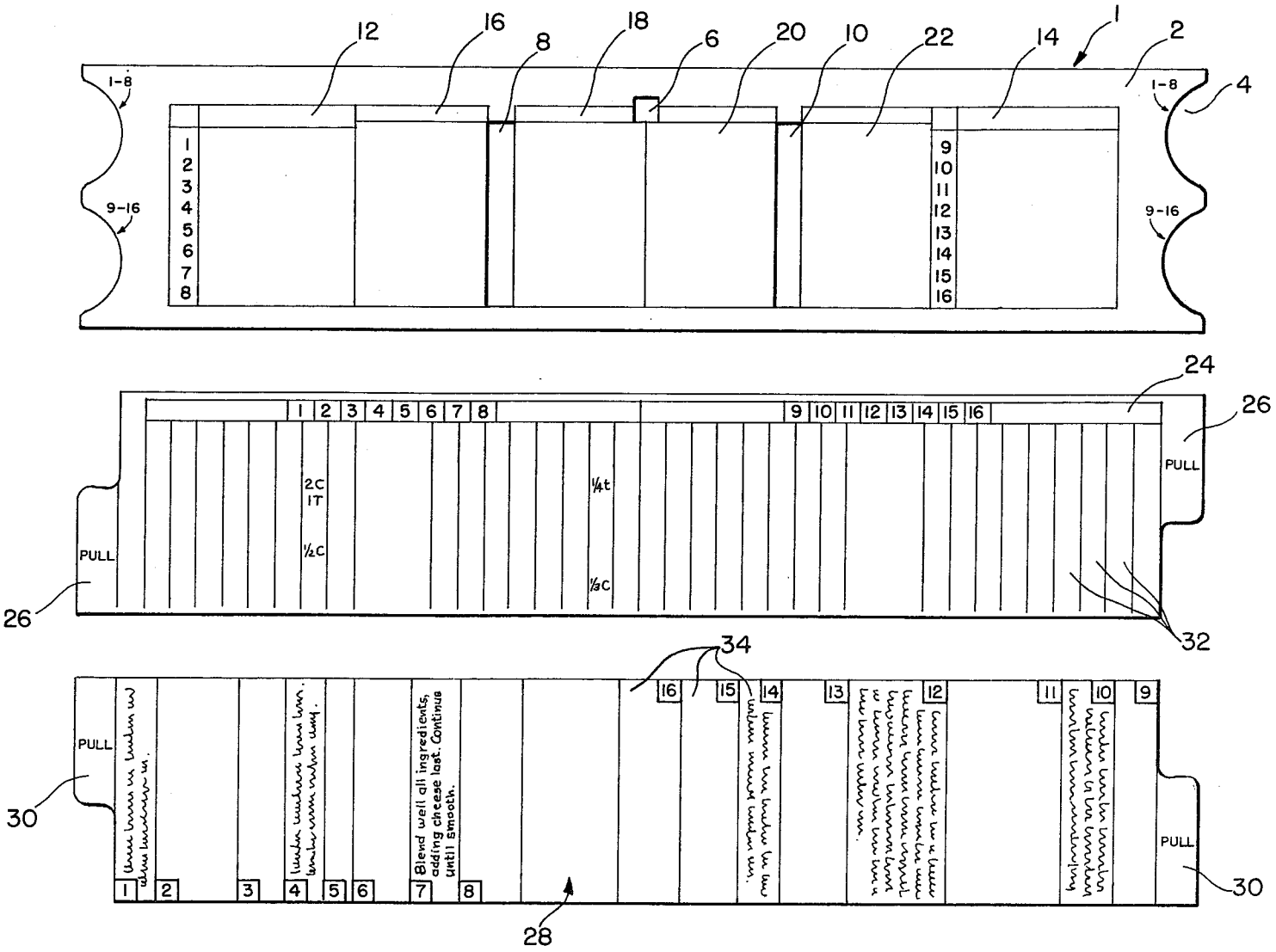
FIG. 2 is an exploded view of the embodiment of FIG. 1, showing details of the components thereof.

A first embodiment of the invention is shown in FIGS. 1 and 2. This is in form a linear slide-rule type menu planner 1 for spreads and dips. It will be understood that the same type of planner is suitable also for other recipes, e.g. canapes, cookies, casseroles, meat sauces, dessert sauces, candies, cake fillings, frostings, mixed drinks and many others.

This type of menu planner may have an overall size of about 9 by 2 inches, i.e. a length of about 9 inches and a height of about 2 inches. However, these dimensions are merely exemplary and may be made smaller or larger, depending upon the number of recipes to be incorporated in the menu planner and the size of the indicia used, aside from questions of convenience in handling and storing the device.

The illustrated menu planner has a sleeve 2 which may be of paper, cardboard, synthetic plastic or any other suitable material. Sleeve 2 is provided at its opposite ends with cut-outs 4 through which the pull-tabs 26 and 30 of respective slides 24 and 28 are engageable by the fingers of the user. Evidently, the number of pull tabs (one shown at each slide end) and of cut-outs 4 (two shown at each end of the sleeve) may be varied.

Sleeve 2 is provided with a number window 6 and, at opposite sides thereof, longitudinally spaced from number window 6, with two elongated parallel ingredient windows 8 and 10, respectively. The surface of the sleeve which is provided with these windows also carries certain blocks of indicia. A block 12 is in form of indicia indicative of the names of certain recipes (the list of recipes is numbered here from one through eight)and extends along the window 8 laterally spaced therefrom. Two further blocks of indicia, namely the blocks 16 and 18, flank the window 8 at opposite lateral sides thereof. Each block 16 and 18 is composed of a list of ingredients which extends along the window 8; the indicia in block 16 are of a different color than those in block 18, e.g. the ones in block 16 may be blue and the ones in block 18 may be red although it is self-evident that other colors may be used. The reason for using two different colors will be explained subsequently.

A second recipe list 14, wherein the recipes are arranged in sequence (here numbered from nine through 16) is arranged along the window 10, spaced along the same but laterally offset from it. Whereas the list 12 is for spreads, the list 14 is for dips, although both lists could evidently be for spreads or both could be for dips. Window 10 is flanked at its opposite lateral sides by two further blocks 20 and 22 of ingredients, and again the indicia in one of the blocks 20 and 22 are of a color which is different from the indicia in the other block 22 or 20.

The slide 24, which is shown in more detail in FIG. 2, is subdivided into a plurality of longitudinally adjacent columns 32 each of which has as many vertical subdivisions (e.g. lines may be provided) as there are ingredients in the respective blocks 16–22. In the illustrated embodiment these blocks each have eleven ingredients listed; consequently, the vertical subdivisions of each column 32 also number eleven. Different columns are provided in one or more of the vertical subdivisions thereof with indicia which indicate the proportions of respective ingredients that are to be used, e.g. in terms of teaspoons (*t*), tablespoons (T), cups (*c*), ounces (*o*) or as required (*x*). Across the top, the strip 24 is provided with a series of numerals corresponding to the numbers of recipes in the blocks 12 and 14, i.e. all together the numerals one through sixteen. The numerals one through eight, corresponding to the numbers of recipes in block 12, are on the left half of slide 24, the remaining numerals nine through sixteen are on the right half thereof.

The second slide 28 is also subdivided vertically into a plurality of longitudinally adjacent columns 34 which are labelled one through sixteen. Each of these subdivisions carries indicia in form of instructions for the preparation of the recipe whose number corresponds to the numbered subdivision on slide 28. It is an important aspect of the invention that the width of the subdivisions 34, in the longitudinal direction of slide 28, need not be — and is not — uniform; this is possible because different recipes require more or less elaborate instructions. For example, recipe five requires very short instructions whereas recipe two requires much longer instructions. Due to this difference in space requirements it is possible to accomodate the need for instructions of differing length and complexity on a single, rather small slide 28.

When the device of FIGS. 1 and 2 is to be used, the user first determines from the recipe blocks 12 and 14 which of the spreads or dips he or she wishes to make. For the sake of explanation, let it be assumed that recipe number seven ("Sherry Cheddar Spread") has been chosen. The user now grips the right-hand pull-tab 26 of slide 24 and pulls the slide out of sleeve 2 until the numeral 7 (at the upper edge of strip 24) becomes visible in the window 6 of sleeve 2. This exposed the indicia of certain of the columns 32 in the windows 8 and 10, each indicium being located opposite two of the ingredients in the lists flanking the windows. Some of the indicia of the columns 32 are in the same color as the indicia of the ingredient lists 16 and 20, whereas others are in the same color as the ingredient lists 18 and 22.

In the case of the selected recipe number 7, the indicia 2*c* become exposed in window 8 opposite the ingredient "egg" in block 16 and also opposite the ingredient "cheddar cheese" in block 18. Since the color of the indicia 2*c* is the same as that of the indicia in block 18, e.g. blue, the user knows that the direction to use two cups pertains to cheddar cheese; i.e., the recipe requires two cups of cheddar cheese. Also exposed in window 8 are the indicia 1 T and ½*c*; these are of the color corresponding to the color of indicia in block 16, e.g. red. The user therefore knows that they pertain to the ingredients of block 16 opposite which ingredients they are located; i.e. the recipe calls for the use of 1 tablespoon of chives and ½ cup of milk. In window 10, the ingredients ¼*t* and ⅓*c* have become exposed and are in red and blue, respectively. The user therefore knows that ¼ teaspoon of mace and ⅓ cup of sherry are required for the recipe.

Having thus determined the required ingredients, the user grips the pull tab 30 of slide 28 and pulls the slide leftwards out of sleeve 2 until the subdivision labelled with the recipe number 7 becomes visible adjacent the left-hand end of sleeve 2. This subdivision 7 provides instructions for the preparation of a sherry-cheddar dip from the ingredients identified in windows 8 and 10, i.e. it directs the user to "Blend well all ingredients, adding cheese last. Continue until smooth."

Should the user wish to select another of the recipes one through eight, he would pull the strips 24 and 28 accordingly. Should the user wish to select one of the dip recipes nine through sixteen, he would grip the left-hand pull tab 26 of strip 24 and pull the strip to the left until the selected recipe number appears in window 6, and he would grip the right-hand pull tab 30 of slide 28 and pull the latter to the right until the instructions for the selected recipe become exposed adjacent the right-hand end of sleeve 2.

The surface of sleeve 2 which is not visible in FIGS. 1 and 2 has not been separately shown to avoid redundancy. However, it should be understood that this second surface is also provided with windows corresponding to the windows 6, 8 and 10, respectively, which may (but need not) be back-to-back with the windows 6, 8 and 10, respectively. Further, this second surface is provided with two additional recipe lists corresponding to the lists 12 and 14 but providing additional recipes which are numbered from seventeen through twentyfour and from twentyfive through thirtytwo, respectively. Ingredient lists corresponding to the lists in blocks 16–22 (but not necessarily with the same ingredients) are associated with the additional recipe lists.

The side of slide 24 which is not visible in FIG. 2 is provided with preparation instructions, similarly to the manner in which such instructions are provided in FIG. 2 on the visible side of slide 28. Conversely, the side of slide 28 which is not visible in FIG. 2 is provided with ingredient columns and indicia for the additional recipes, similarly to the manner in which such information is shown on the visible side of slide 24 in FIG. 2.

Thus, the total number of recipes, their ingredients, proportions of ingredients and preparation instructions, which can be read off the device shown in FIGS. 1 and 2, is thirtytwo. That number could, of course, be made smaller or larger depending upon particular requirements, size of the device, size of the indicia, and the like.

Figure 3:
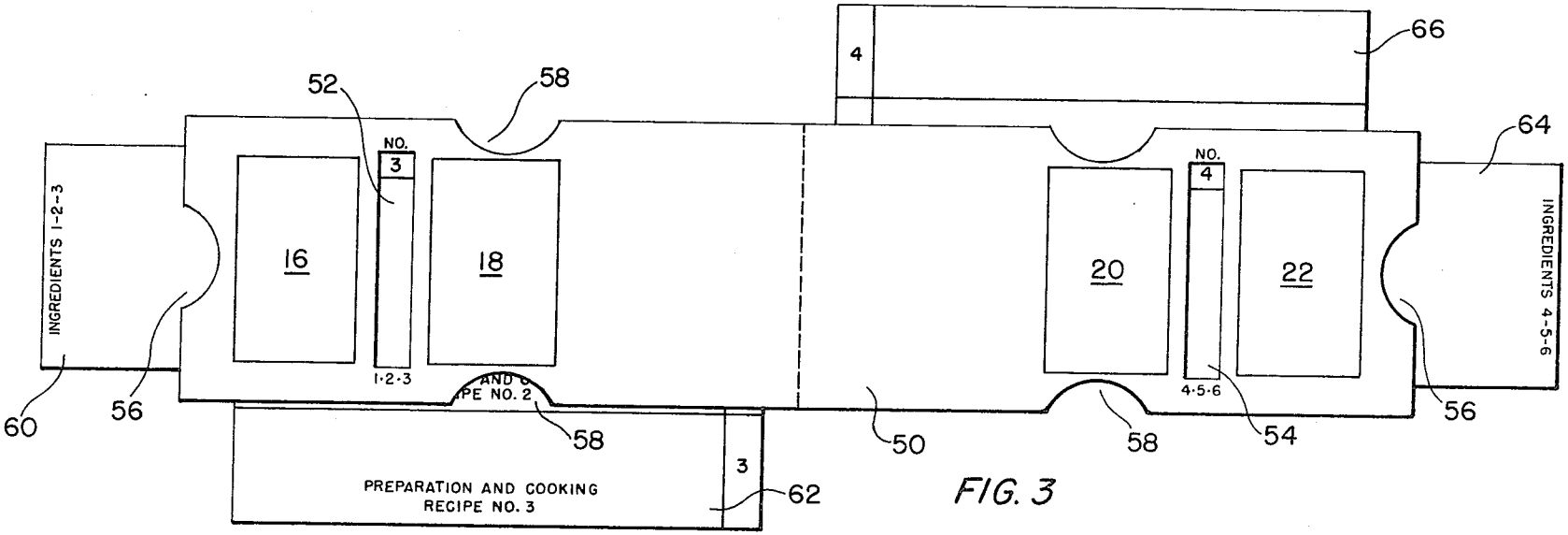
FIG. 3 is a view analogous to FIG. 1, but illustrating another embodiment of the invention.

A second embodiment of the invention is illustrated in FIG. 3. This embodiment is of particular advantage when a larger space is required, especially for the preparation instructions, such as in the case of cakes, entrees and the like.

The embodiment of FIG. 3 again has a sleeve, here identified with reference numeral 50. The interior of the sleeve is subdivided into two longitudinal halves, e.g. by one or more spots of glue, a staple or any other suitable means, so that the sleeve 50 has a left-hand interior compartment and a right-hand interior compartment.

Only the information with respect to the surface of the sleeve 50 which is visible in FIG. 3 will be described; the same description applies also to the surface which is not visible.

Sleeve 50 is provided at its opposite axial ends with finger cut-outs 56; each of the left-hand and right-hand sections is provided at its upper and lower edge (both of which are open over most of the axial length of the respective section) with further finger cut-outs 58. Each section is also provided with an elongated window 52, 54, respectively. Two slides 60 and 62 are provided for each section; the slide 60 is movable horizontally in sleeve 50 whereas the slide 62 is movable vertically. The left-hand portion of slide 60, i.e. the portion to be exposed outside sleeve 50, carries a list of ingredients in a manner analogous to the blocks 16, 18, 20 or 22. The inner or right-hand portion of the slide 60 carries a number of columns similar to the columns 32 and corresponding to the number of recipes, for example three columns for three recipes. To select one of the numbered recipes which may be printed on the sleeve surface in the left-hand section, slide 60 is pulled left until the number of the desired recipe on the slide becomes exposed in window 52; this also exposes the proportions of the ingredients to be used, such proportions to be read towards the left against the ingredient list on the left-hand exposed portion of slide 60. Now the slide 62 is pulled downwardly out of sleeve 50 until the preparation and/or cooking instructions pertaining to the selected recipe become exposed and can be read. Since only a comparatively small number of recipes (here three) is dealt with on slide 62, there is space for quite extensive instructions.

Slides 64 and 66 are provided in the right-hand section of the sleeve and correspond in use to the slides 60 and 62, except that they are directed towards additional recipes, e.g. reciped four through six. The sides of slides 60 and 64 which are not visible in FIG. 3 may be provided with the information pertaining to the ingredients for additional recipes, for example for recipes seven through nine and 10 through 12, respectively. The sides of slides 62 and 66 which are not visible in FIG. 3 may carry the preparation and/or cooking instructions for the additional recipes seven through 12. Of course, the information pertaining to these additional recipes could be provided on two additional slides similar to the slides 60,62 and on two additional slides similar to the slides 64 and 66, and arranged in back-to-back relationship with the same. Also, the number of recipes could be smaller or, more advantageously, larger than the exemplary numbers of recipes shown and described with reference to FIG. 3. Each section of the sleeve could be provided on each side with a second slide which cooperates with the slides 62 or 66, respectively. For example, slide 62 could carry only preparation instructions (pull down out of sleeve) and the additional slide (to be pulled up out of the sleeve) could carry only the cooking instructions.

It should be understood that various modifications in the invention, and departures from the illustrated embodiments, are possible without thereby departing from the scope and intent of the invention. For example, the invention could also be employed in form of a "circular slide-rule" format, although the linear format is currently preferred because the selecting of ingredients and other instructions appears simpler in this format. Also, instead of reading both windows 8 and 10 together in FIGS. 1 and 2, the arrangement could be such that for each recipe the ingredients are to be read off in only one window. If it is desired or necessary to avoid confusion in the read-out, this could be accomplished by having the ingredients for some of the recipes read with the device in the normal position (i.e. as shown in FIG. 1) and for other recipes requiring the device to be turned upside-down to permit reading of the ingredients and instructions pertaining to the other list or lists of recipes. Other recipes can and are intended to be used; the manner in which their ingredients are to be listed and the proportions to be provided on the slides, can be readily determined empirically and require no explanation.

The invention has been described with reference to two exemplary embodiments. However, it is to be understood that the invention is not to be considered limited to those two embodiments which have been used only for purposes of explanation and that the above modifications, and others which will suggest themselves to persons having skill in the art, are intended to be encompassed within the scope of protection sought for this invention.

I claim:

1. A menu-planner, comprising a jacket element in form of an elongated sleeve bounding an interior space and having axially spaced open ends and an exposed outer surface provided with a first window and with two elongated substantially parallel second windows; first indicia means on said surface, including a list of consecutively numbered recipes and two pair or ingredient lists, the lists of each of said pairs flanking a respective one of said second windows along opposite lateral sides thereof with the ingredients of each list being arranged seriatim along the length of the respective window; means comprising at least two slide members each movable in said space relative to said windows longitudinally of said sleeve to a plurality of positions in each of which a portion of the respective slide member is exposed outside said space; and second indicia means on said movable means and indicative of recipe numbers, proportions of said ingredients and instructions for preparation of the respective recipe so that, upon movement of the respective slide members to a position in which a selected recipe number appears in said first window, indicia indicative of the proportions in which respective ones of said ingredients are required for the selected recipe will appear in said second windows opposite the required ingredients and preparation instructions will become exposed on said portion of said movable means outside said space and adjacent said surface.

2. A menu-planner as defined in claim 1, wherein said sleeve is provided in each of said open ends with at least one longitudinally extending recess through which a respective one of said slide members is engageable by the fingers of the user.

3. A menu-planner as defined in claim 1, wherein each of said slide members is in form of an elongated strip and has two longitudinally spaced sections of which one is provided with said second indicia means indicative of proportions of ingredients for some of said recipes and of which the other is provided with said second indicia means indicative or proportions of ingredients for others of said recipes.

4. A menu-planner as defined in claim 1, said sleeve having an additional outer surface also provided with one of said first and two of said second windows; additional first indicia means on said additional surface; and additional second indicia means on said movable means and adapted to be exposed in said additional first and second windows and outside said space adjacent said additional outer surface.

5. A menu-planner as defined in claim 4, wherein at least the recipe list formed by said additional indicia means and the instructions for preparation formed by said additional second indicia means differ from the recipe list and the instructions for preparation formed by said first and second indicia means, respectively.

6. A menu-planner as defined in claim 1, said elongated sleeve having an additional outer surface facing away from the first-mentioned outer surface and provided with a first and two second windows and with first indicia means all corresponding to the first-mentioned windows and first indicia means; and wherein said members are two strips normally overlying one another and each having a face directed towards one of said outer surfaces and another face directed towards the other of said outer surfaces and facing the other face of the respective other strip, said second indicia means indicative of recipe number and proportions of ingredients being provided on said one faces of said strips for exposure in said first and second windows, respectively, and said second indicia means indicative of instructions being provided on said other faces of said strips.

7. A menu-planner as defined in claim 6, wherein said strips each have a length substantially coextensive with the length of said sleeve.

8. A menu-planner, comprising a jacket element bounding interior space having open sides and also having an exposed outer surface provided with a window;

first movable means comprising a first member having a first indicia-bearing face composed of two sections and being movable in said space between a plurality of positions in each of which a part of one of said sections is exposed in said window and a part of the other of said sections extends through one of said open sides to the exterior of said jacket element;

second movable means including a second member having a second indicia-bearing face and also being movable in said space between a plurality of positions in each of which a portion of said second indicia-bearing face extends through another of said open sides to the exterior of said jacket element;

first indicia means forming a seriatim list of ingredients on said part of said other section;

second indicia means on said part of said one section and forming a list of proportions of ingredients which is adapted to become exposed in said window in response to selection of one of a plurality of recipes; and third indicia means indicative of preparation instructions provided on said second indicia-bearing face and adapted to become exposed in response to movement of said second member to one of said positions thereof corresponding to a respective one of said recipes.

9. A menu-planner, comprising a sleeve having spaced open ends and respective open sides intermediate said open ends, said sleeve having two exposed outer surfaces each provided with two windows which are spaced longitudinally of said sleeve;

first movable means, comprising two first elements each located in said space and provided with two opposite first indicia-bearing faces each composed of two sections, each first element being slidable through one of said open ends to a plurality of positions in each of which a part of one of said sections of a respective face is exposed in one of said windows and a part of the other section of the same face extends through said one open end to the exterior of said sleeve;

second movable means, comprising two second members each also located in said space and provided with two opposite second indicia-bearing faces, each of said second members being movable through one of said open sides to a plurality of positions in each of which a portion of a respective second indicia-bearing face extends to the exterior of said sleeve;

first indicia means forming on each of said parts of said other sections a respective seriatim list of ingredients;

second indicia means on each of said parts of said one sections and forming thereon a respective list of ingredient proportions adapted to become exposed in one of said windows in response to selection of one of a plurality of recipes; and third indicia means indicative of preparation instructions on the respective second indicia-bearing faces and adapted to become exposed in response to movement of the respective second member to one of said positions thereof corresponding to a respective one of said recipes.

10. A menu planner, comprising a jacket element bounding an interior space and having an exposed outer surface provided with a first window and with two elongated substantially parallel second windows; first indicia means on said surface, including a list of consecutively numbered recipes and two pair of ingredient lists, the lists of each of said pairs flanking a respective one of said second windows along opposite lateral sides thereof with the ingredients of each list being arranged seriatim along the length of the respective window; means movable in said space relative to said windows to a plurality of positions in each of which a portion of said movable means is exposed outside said space; and second indicia means on said movable means and indicative of recipe numbers, proportions of said ingredients and instructions for preparation of the respective recipe so that, upon movement of said movable means to a position in which a selected recipe number appears in said first window, indicia indicative of the proportions in which respective ones of said ingredients are required for the selected recipe will appear in said second windows opposite the required ingredients and preparation instructions will become exposed on said portion of said movable means outside said space and adjacent said surface, some of said first indicia being of one color and others thereof being of a different color, and some of said second indicia also being of said one color and others thereof also being of said other color so as to indicate ingredients of the respective ingredient list by color matching.

11. A menu planner, comprising a jacket element bounding an interior space having an exposed outer surface provided with a first window and with two elongated substantially parallel second windows; first indicia means on said surface, including a list of consecutively numbered recipes and two pair of ingredient lists, the lists of each of said pairs flanking a respective one of said second windows along opposite lateral sides thereof with the ingredients of each list being arranged seriatim along the length of the respective window; means movable in said space relative to said windows to a plurality of positions in each of which a portion of said movable means is exposed outside said space; and second indicia means on said movable means and indicative of recipe numbers, proportions of said ingredients and instructions for preparation of the respective recipe so that, upon movement of said movable means to a position in which a selected recipe number appears in said first window, indicia indicative of the proportions in which respective ones of said ingredients are required for the selected recipe will appear in said second windows opposite the required ingredients and preparation instructions will become exposed on said portion of said movable means outside said space and adjacent said surface, some of said first indicia having one visually identifying characteristic and others thereof having a different visually identifying characteristic, and some of said second indicia also having said one visually identifying characteristic whereas others thereof also have said different visually identifying characteristic, so as to indicate ingredients of the respective ingredient list by matching of the like visually identifying characteristics.

* * * * *